US008210421B2

(12) United States Patent
Dulac et al.

(10) Patent No.: US 8,210,421 B2
(45) Date of Patent: Jul. 3, 2012

(54) METHOD FOR SEPARATING CROPPED LAYERS FROM PLATED STRIPS BY ROLL BONDING

(75) Inventors: Sandrine Dulac, Grenoble (FR); Christian Barthelemy, Voiron (FR); Sylvain Henry, Saint-Jean de Moirans (FR); Armand Gabriel, Le Fontanil (FR)

(73) Assignee: Constellium France, Courbevoie (FR)

( * ) Notice: Subject to any disclaimer, the term of this patent is extended or adjusted under 35 U.S.C. 154(b) by 1280 days.

(21) Appl. No.: 10/558,753

(22) PCT Filed: Jun. 1, 2004

(86) PCT No.: PCT/FR2004/001342

§ 371 (c)(1), (2), (4) Date: Dec. 1, 2005

(87) PCT Pub. No.: WO2005/002750

PCT Pub. Date: Jan. 13, 2005

(65) Prior Publication Data

US 2007/0031695 A1 Feb. 8, 2007

(30) Foreign Application Priority Data

Jun. 5, 2003 (FR) ..... 03 06781

(51) Int. Cl.
*B23K 20/18* (2006.01)

(52) U.S. Cl. ..... 228/118

(58) Field of Classification Search ..... 228/115, 228/117, 118, 141.1, 149, 158, 159, 160, 228/173.1, 173.2, 173.6, 235.2, 17; 493/82–83, 493/342, 373

See application file for complete search history.

(56) References Cited

U.S. PATENT DOCUMENTS

| | | | | | |
|---|---|---|---|---|---|
| 2,957,230 | A | * | 10/1960 | Johnson | 228/118 |
| 3,015,157 | A | * | 1/1962 | Reynolds et al. | 228/118 |
| 3,195,333 | A | * | 7/1965 | McDaniel | 72/46 |
| 3,938,723 | A | | 2/1976 | Slaughter | |
| 3,981,753 | A | * | 9/1976 | Hopper | 148/23 |
| 4,203,762 | A | | 5/1980 | Dansereau | |
| 5,994,666 | A | * | 11/1999 | Buldhaupt et al. | 219/121.64 |
| 2004/0249039 | A1 | | 12/2004 | Lamaze et al. | |

FOREIGN PATENT DOCUMENTS

| | | | |
|---|---|---|---|
| FR | 2830857 | | 4/2003 |
| JP | 09010965 | | 1/1997 |
| WO | WO-99/32260 | | 7/1999 |
| WO | WO-00/67942 | | 11/2000 |
| WO | WO 03/033435 | * | 4/2003 |

* cited by examiner

*Primary Examiner* — David R Sample
*Assistant Examiner* — Megha Mehta
(74) *Attorney, Agent, or Firm* — Baker Donelson Bearman, Caldwell & Berkowitz, PC

(57) ABSTRACT

A process for the manufacture of plated strips comprising at least two layers of different metals or alloys. The process allows subsequent separation of different cropped layers resulting from shearing the plated strips. The process comprises preparing plates corresponding to each of the plating layers, superimposing and assembly of these plates to form a composite plate, hot and possibly cold rolling of this composite plate to obtain a plated strip, and shearing of cropping areas during or after rolling. In one embodiment, prior to superimposing the different plates, an anti-sticking agent is applied to the cropping areas of at least one of the surfaces of the plates which will be in contact with each other.

6 Claims, No Drawings

METHOD FOR SEPARATING CROPPED LAYERS FROM PLATED STRIPS BY ROLL BONDING

CROSS REFERENCE TO RELATED APPLICATIONS

This application is a 371 National Stage application of International Application No. PCT/FR04/001342 filed Jun. 1, 2004 which claims priority to French Application No. 03/06781 filed Jun. 5, 2003, the contents of which is incorporated herein by reference in their entirety.

BACKGROUND OF THE INVENTION

1. Field of the Invention

The invention relates to a method for separating different cropped layers from plated strips, which are plated by roll bonding. More particularly, the cropped material results from shearing the edges and ends of the plated strip at the various stages in their process of manufacture.

2. Description of Related Art

The technique has been known for many years of manufacturing metal strips constituted by two or more layers of different metals or alloys plated over each other by simultaneous hot and/or cold rolling. For example, in the case of aluminium alloys, there is a substantial production of AlMn or AlFe alloy strips plated with AlSi alloy; these strips are destined particularly for the manufacture of brazed heat exchangers, with the plating alloy AlSi acting as the brazing alloy.

Metal strip manufacture generates, at the different stages of this manufacture, relatively large quantities of cropped material or scrap, which are more often than not recycled in the factory itself by being added to the primary metal used for the casting of semi-products. In the case of plated strips comprising different metals or alloys, the direct recycling of the cropped material in the metal furnace in which the casting metal was developed produces an alloy which is different from the starting alloys, and which is not always usable. Attempts have therefore been made to separate the different layers of cropped plated strips in order to allow them to be recycled separately in the production process.

One known method for implementing this separation is to bring the plated cropped material to a temperature somewhere between the melting points of the two metals or alloys to be separated. Such a process is described for example in U.S. Pat. No. 4,203,762 in respect of steel-aluminium plated strips, and in patent applications WO 99/32260 and WO 00/67942 in respect of Al/Mn aluminium alloy strips plated with an AlSi alloy destined for the manufacture of brazed heat exchangers, thermal separation being accompanied by mechanical separation, by abrasion or shearing. A process of this type requires a massive consumption of energy and costly investment in furnaces.

The purpose of the invention is to obtain a separation process that is straightforward, cost-effective and can easily be applied to industrial production.

SUMMARY OF THE INVENTION

The subject of the invention is a process for the manufacture of plated strips comprising at least two layers of different metals or alloys, that allows the subsequent separation of the different cropped layers resulting from shearing the plated strips, comprising the preparation of plates corresponding to each of the plating layers, the superimposition and assembly of these plates to form a composite plate, the hot and possibly cold rolling of this composite plate to obtain a plated strip, and the shearing of the cropping areas during or after rolling, a process wherein, prior to superimposing the different plates, an anti-sticking agent is applied to the cropping areas of at least one of the surfaces of the plates that will be in contact with each other.

The anti-sticking agent is preferably a slip comprising a ceramic oxide in an aqueous or organic solvent.

DETAILED DESCRIPTION OF A PREFERRED EMBODIMENT

The manufacture of plated metal strips comprises the preparation, by casting and possibly rolling, of plates of different thickness, corresponding to the different layers of the product being made. The plates are then superimposed and anchored to the adjacent plate, for example by welding points or beads. The whole thing is then hot-rolled, and possibly, if the end thickness to be attained requires it, cold-rolled. The rolling is implemented with a certain number of runs with, if necessary, one or more intermediary annealing operations between some of the runs.

It is customary, on emergence from hot rolling, and once again after cold rolling, to shear the edges, the ends or other areas of the strips which may have defects or cracks. This operation is even more necessary for plated strips, since the different layers may have a different edge or end profile. For obvious economic reasons, the cropped materials have to be recovered in order to be recycled in the melting furnace used to cast the starting plates, as is the case for non-plated strips. But such recycling is only possible if the different plated layers are separated from each other.

The invention consists, in its more general thrust, in allowing an easy separation of the different layers of the cropped plated layers by applying, to the cropping areas, notably the edges, of at least one of the plates to be superimposed one on the other, an anti-sticking agent, in other words a product which, after being subjected to thermal-mechanical treatment corresponding to hot rolling and possibly cold rolling, and any potential intermediate annealing operations, locally prevents one layer being welded to the other, and thus allows an easy separation of the layers.

One type of particularly well adapted application consists of a slip constituted by a mineral powder, notably an oxide or a boride, and a silicon resin in solution in an organic phase or in suspension in an aqueous phase. Patent application FR 2830857 describes such products in organic phase to obtain protective coatings for materials or pieces of equipment intended to be exposed to an oxidising environment, to liquid metal or to a molten salt.

This slip may be applied by any appropriate means, for example with a brush, with a roller or with a gun. It can also be applied by electrostatic dusting. After application, the applied agent is polymerised by being heated to a temperature of about 500° C. This heating may be implemented using a heat gun spray for example. It is also possible to use the plate preheating stage prior to hot rolling.

Experience shows that the applied agent in no way inhibits subsequent rolling operations, that it does not migrate into the inner part of the plates, and that neither is it expelled outwards. The cropped part layers, notably those arising out of hot-rolled strips, can be separated easily simply by peeling. Peeling is rather less easy for cold-rolled strips, particularly in the case of thin strips, since the layers are too thin to stay all in one piece.

If necessary, separation according to the invention can be combined with other prior art techniques, in other words thermal separation at an intermediate temperature between the solidus temperatures of the superimposed alloys, or mechanical separation using abrasive tools or shearing.

Example

A 350×500 mm format 3003 alloy plate with a thickness of 120 mm was cast and a 4343 alloy plate of somewhat smaller format with a thickness of 13 mm was prepared by casting and rolling. The plates were degreased with xylene.

A slip was made based on alumina dispersed in aqueous phase. The alumina is the Aluminium Pechiney product P152SB with a particle size distribution $d_{50}$ of 1.5 μm and with a specific surface area BET of about 3 $m^2/g$. 100 g of this alumina, 17 g of MK silicon resin (poly-methyl-siloxane) from the company Wacker Chemie and 50 g of permuted water were mixed together. The mixture was agitated for one hour.

A 50 mm wide layer of this slip was applied to the two edges of the 3003 plate, this area representing the width of the edges that it was required to shear. The deposit was then polymerised by heating at a slowly rising temperature to 500° C., then kept for four hours in a draught furnace.

Onto the 3003 plate was then deposited the 4343 covering plate and the two plates were welded using a few MIG welding points. The whole thing was then hot rolled, in the traditional way, to a thickness of 3 mm. The two edges were then sheared each over a width of 50 mm. The strip was then cold rolled to a final thickness of 0.5 mm, which equates to a usual thickness for plated strips destined for the manufacture of the brazed heat exchangers used in motor vehicles.

For the cropped edges of hot-rolled strips, the 3003 alloy layer can very easily be separated from the 4343 layer, simply by using a screwdriver for example. This separation is also easy in respect of the cropped edges of cold-rolled strips, but the 4343 layer is too thin and too fragile and it is torn into shreds.

The invention claimed is:

1. Process for the manufacture of an aluminum plated strip comprising at least two plating layers of two different aluminum alloys, said process comprising:

preparing plates corresponding to each plating layer, superimposing and assembling said plates to form a composite plate, prior to superimposing the plates, applying an anti-sticking agent to cropping areas of at least one surface of each plate which will be in contact with a surface of another one of the plates, wherein said anti-sticking agent comprises a mixture of a mineral powder and a silicon resin in suspension in water or in an organic solution, wherein the inclusion of said anti-sticking agent allows the subsequent separation of the cropped layers resulting from shearing the plated strip, hot and optionally cold rolling of said composite plate to obtain a plated strip, shearing cropping areas of each of said plates during or after rolling, and separately recycling the cropping layers resulting from shearing the plated strip.

2. Process according to claim 1, wherein the mineral powder is an oxide or a boride.

3. Process according to claim 2, wherein the mineral powder is alumina.

4. Process according to claim 1, wherein the anti-sticking agent is applied by electrostatic dusting.

5. A plated strip prepared from a process of claim 1.

6. A cropping area that has been separated from a plated strip prepared according to claim 1.

* * * * *